US005453729A

United States Patent [19]

Chu

[11] Patent Number: 5,453,729

[45] Date of Patent: Sep. 26, 1995

[54] SOLAR WARNING LIGHT

[76] Inventor: Chiu-Tsai Chu, P.O. Box 82-144, Taipei, Taiwan

[21] Appl. No.: 98,021

[22] Filed: Jul. 28, 1993

[51] Int. Cl.[6] ..... G08B 5/00

[52] U.S. Cl. ..... 340/332; 340/331; 340/321; 340/908.1; 340/908; 362/157; 362/183

[58] Field of Search ..... 340/908.1, 908, 340/983, 981, 331–333, 321, 691, 693; 362/157, 183

[56] References Cited

U.S. PATENT DOCUMENTS

| | | | |
|---|---|---|---|
| 4,626,852 | 12/1986 | Dodge | 340/331 |
| 4,736,186 | 4/1988 | Jones | 340/331 |
| 4,759,735 | 7/1988 | Pagnol et al. | 340/331 |
| 4,841,278 | 6/1989 | Tezuka et al. | 340/908.1 |
| 4,904,998 | 2/1990 | Niimi | 340/908.1 |
| 5,262,756 | 11/1993 | Chien | 340/332 |

*Primary Examiner*—Donnie L. Crosland

*Attorney, Agent, or Firm*—Alfred Lei

[57] ABSTRACT

A solar warning device and in particular to one including: a solar chip device having a mushroom-like top with an annular flange and a rectangular recess for receiving solar cells, said rectangular recess being filled with silicon for fixing the solar cells in position, said solar chip device further having two downwardly extending legs; a reflecting device having a cylindrical casing with reflecting lines at an inner surface and a neck at a top, a light mounting disposed within said cylindrical casing and having a top plate, a base plate, a light-emitting diode fixing plate, and a pillar, said fixing plate being formed with a plurality of holes for keeping light-emitting diodes in place, a printed circuit board mounted under the base plate of said light mounting, and a conducting pin mounted on a positive pole of said printed circuit board and extending downwardly through said cylindrical casing; and a fixing device having a cylinder provided at a top with external threads adapted to engage with internal threads of the cylindrical casing of said reflecting device, ribs for keep a battery in position, and a L-shaped copper conductor having a lower end designed to be in contact with a negative pole of the battery.

9 Claims, 10 Drawing Sheets

SOLAR WARNING LIGHT

BACKGROUND OF THE INVENTION

It has been found that numerous solar warning lights have been provided in prior art that are adapted to use nickel-cadmium batteries as power sources to produce warning light. While these units may be suitable for the particular purpose to which they address, they would not be suitable for the purposes of the present invention heretofore described.

Therefore, it is an object of the present invention to provide an improved solar warning light which may obviate and mitigate the drawbacks of the prior art.

SUMMARY OF THE INVENTION

This invention relates to an improved solar warning light.

It is the primary object of the present invention to provide a solar warning light which is adapted for use with nickel-cadmium battery as well as dry battery.

It is another object of the present invention to provide a solar warning light which will always keep the light-emitting diode at a voltage for giving its highest illumination intensity.

It is still another object of the present invention to provide a solar warning light which may concentrate the light within the casing.

It is still another object of the present invention to provide a solar warning light which is energy-saving.

It is a further object of the present invention to provide a solar warning light which may still charge the rechargeable even in gloomy day.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
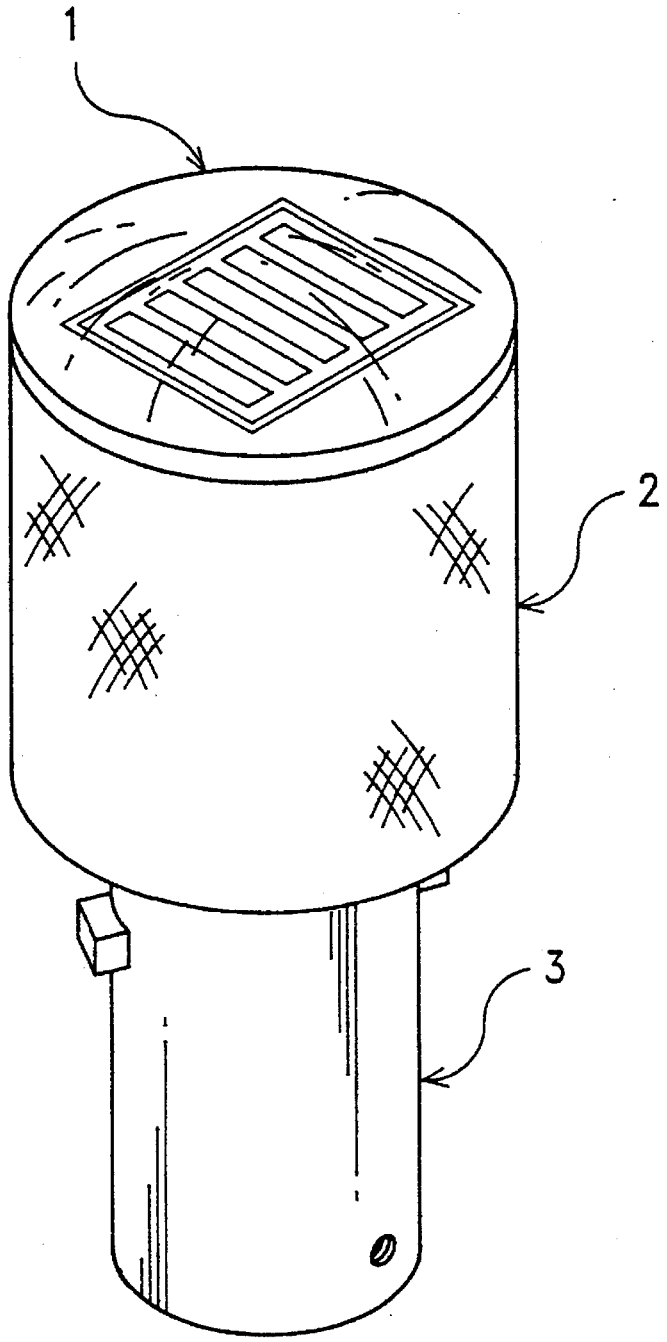
FIG. 1 is a perspective view of the present invention.

With reference to the drawings and in particular to FIG. 1 thereof, the solar warning light according to the present invention mainly comprises a solar chip device 1, a reflecting device 2, and a fixing device 3.

Figure 2:
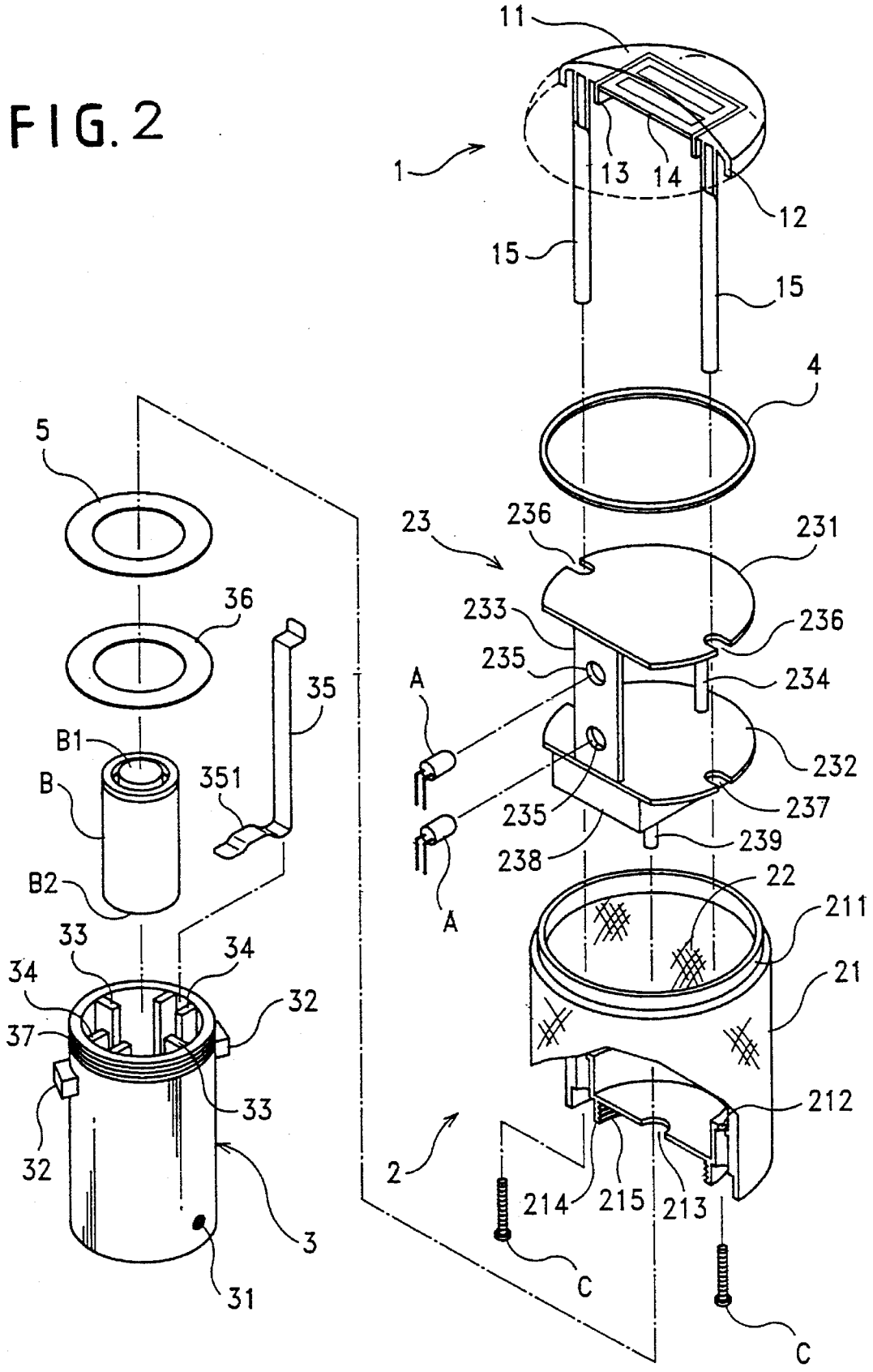
FIG. 2 is an exploded view of the present invention.
Figure 3:
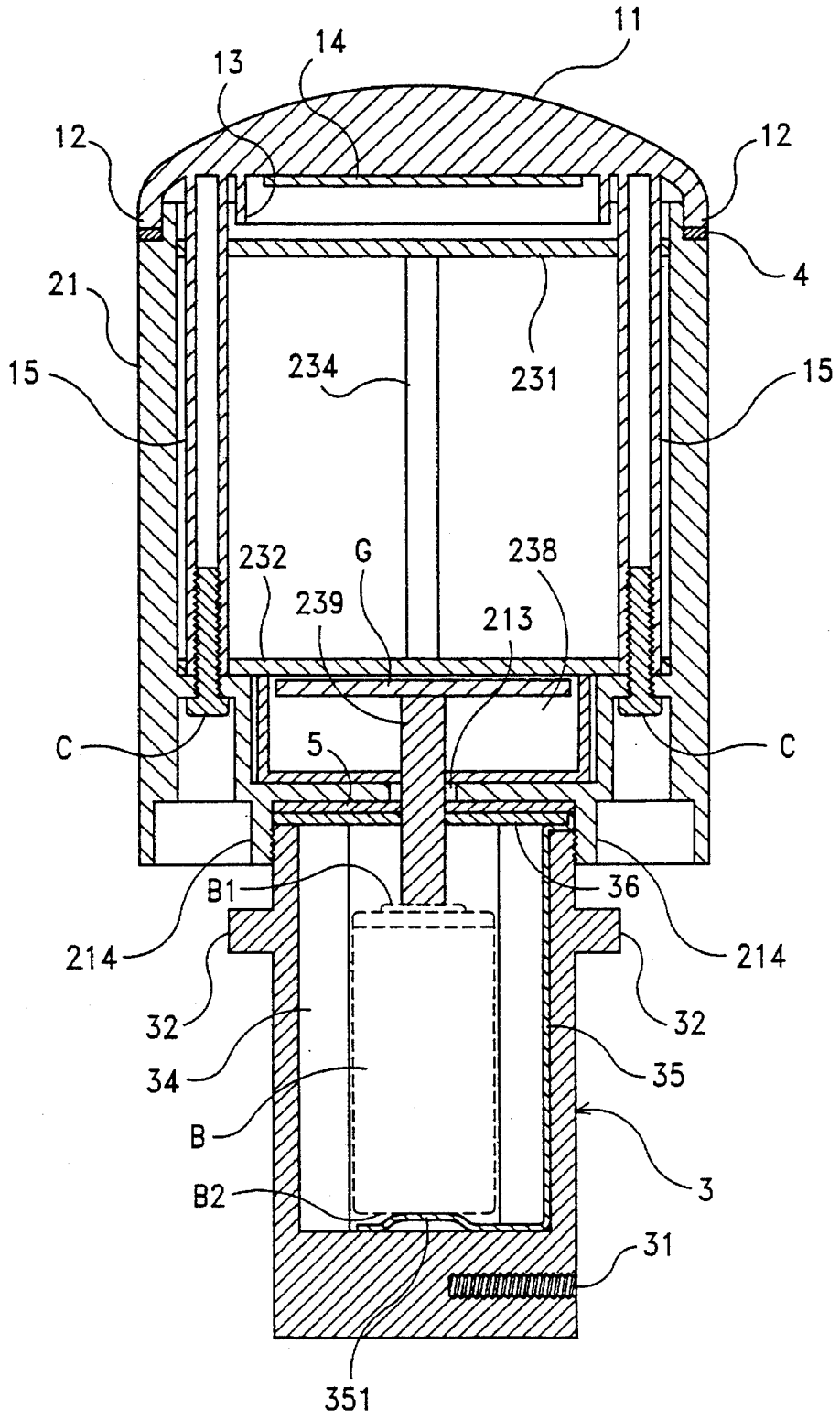
FIG. 3 is a sectional view of the present invention.

Referring to FIGS. 2 and 3, the solar chip device 1 has a mushroom-like top 11 with an annular flange 12, and a rectangular recess 13 for receiving solar cells 14. Then, the rectangular recess 13 is filled with silicon for fixing the solar cells 14 in position. Further, the solar chip device 1 is provided with two downwardly depending legs 15.

The reflecting device 2 includes a transparent cylindrical casing 21 with reflecting lines 22 at its inner surface and a neck 211 at its top. The lower part of the cylindrical casing 21 is formed with two threaded holes 212 adapted to engage the legs 15 of the solar chip device 1 and a recess 214 with internal threads 215 and a center hole 213. A light mounting 23 is disposed within the cylindrical casing 21 and has a top plate 231, a base plate 232, a light-emitting diode fixing plate 233, and a pillar 234. The fixing plate 233 is formed with a plurality of holes 235 for keeping light-emitting diodes A in place. The top plate 231 and the base plate 231 are respectively formed with notches 236 and 237 at both sides for receiving the legs 15 of the solar chip device 1. Further, a printed circuit board G is mounted in a room 238 formed under the base plate 232 and kept in position by silicon. A conducting pin 239 is mounted on the positive pole of the printed circuit board G and downwardly extends through the center hole 213 of the cylindrical casing 21.

The fixing device 3 comprises a cylinder provided at the top with external threads 37 adapted to engage with internal threads 215 of the cylindrical casing 21. Further, the fixing device 3 has a threaded hole 31 at the lower part and a pair of lugs 32 at the upper part. In the fixing device 3 there are ribs 33 and 34 for keeping a battery B in place. Between two ribs 34 is fitted a L-shaped copper conductor 35. On the top of the fixing device 3 there is an annular copper ring 36 in contact with the upper end of the L-shaped copper conductor 35. The lower end 351 of the L-shaped copper conductor 35 is in contact with the negative pole B2 of the dry battery B while the positive pole B1 of the dry battery B is in contact with lower end of the conducting pin 239.

A water-proof packing ring 4 is fitted between the solar chip device 1 and the reflecting device 2. Further, a water-proof rubber packing 5 is fitted between the reflecting device 2 and the fixing device 3.

Figure 4A:
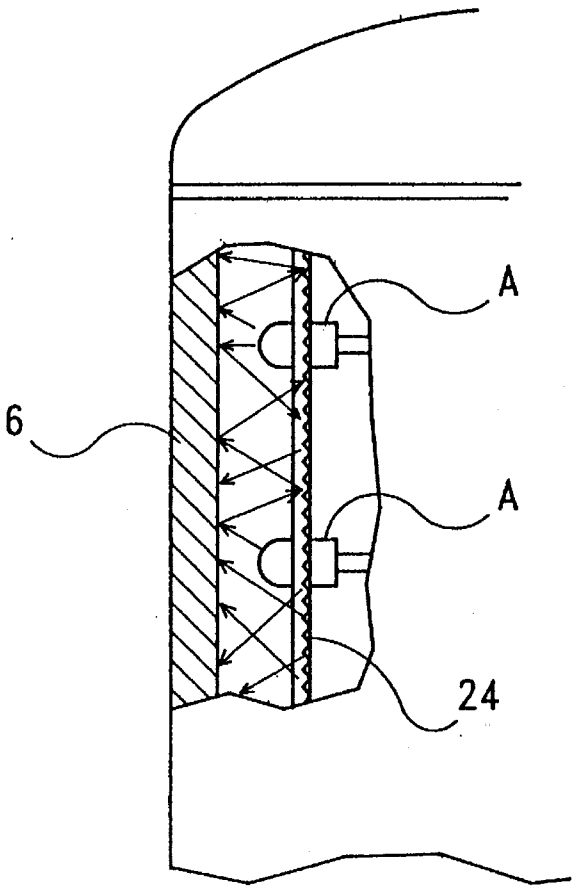
FIG. 4A is an enlarged fragmentary view of FIG. 4.
Figure 4:
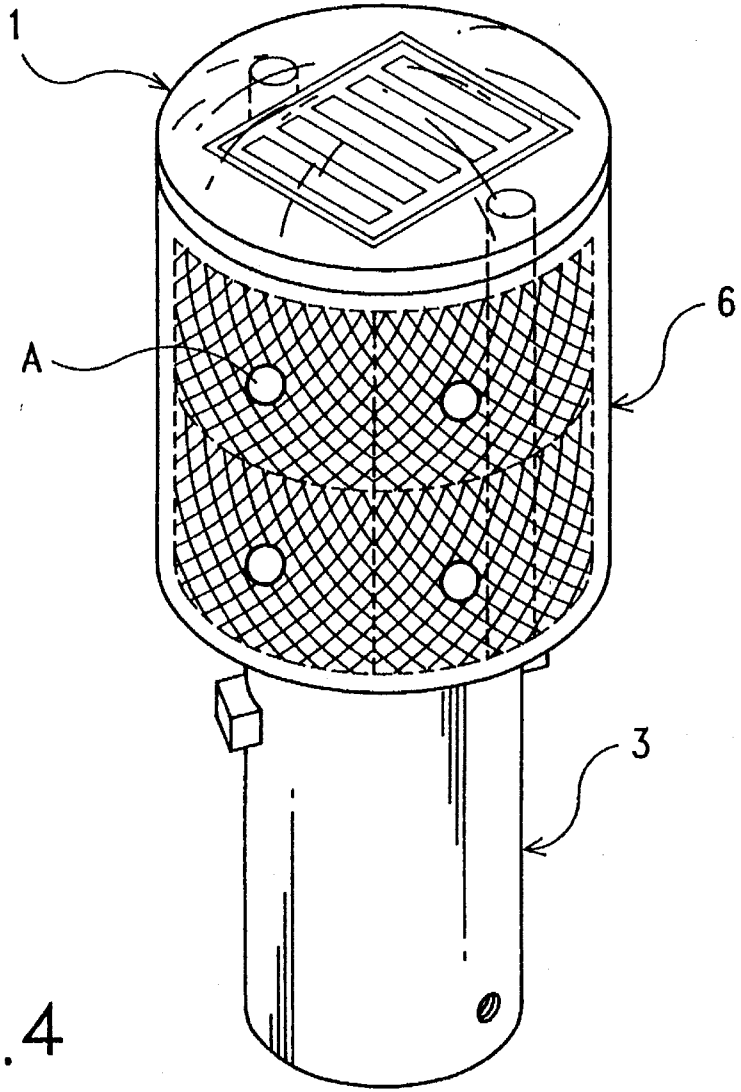
FIG. 4 is a perspective view of a second preferred embodiment according to the present invention.
Figure 5:
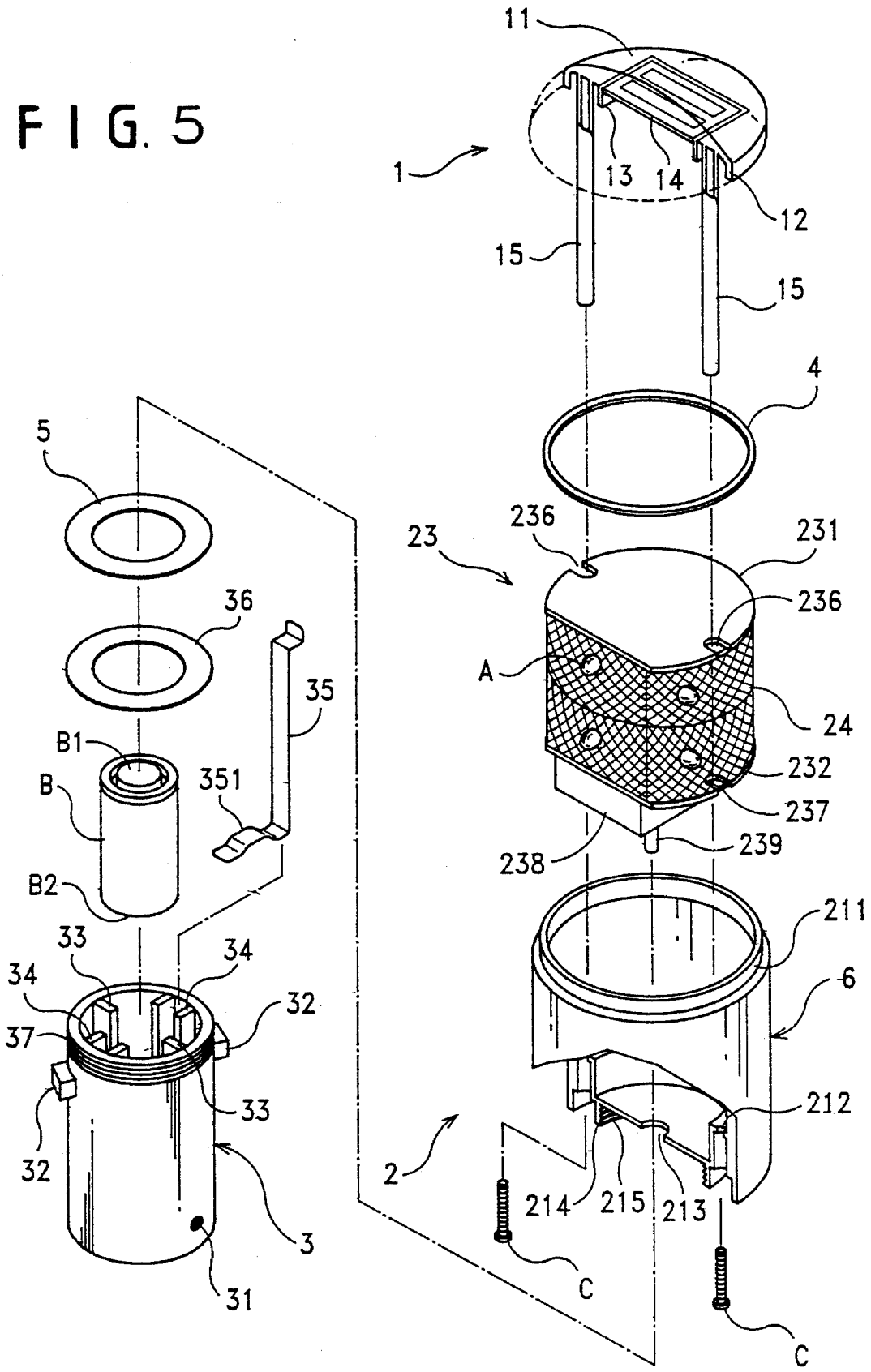
FIG. 5 is an exploded view of the second preferred embodiment.

FIGS. 4, 4A and 5 show another preferred embodiment of the present invention. As illustrated, a reflecting member 24 is mounted between the top plate 231 and the base plate 232 of the light mounting 231. The light-emitting diodes A are directly mounted on the reflecting member 24 instead of the light-emitting diode fixing plate 233 shown in FIG. 2. The cylindrical casing 21 shown in FIG. 2 is replaced with a dust-proof cover 6. The difference between the cylindrical casing 21 and the dust-proof cover 6 is that the inner wall of the latter is not provided with reflecting lines 22. Hence, the light emitted by the light-emitted diodes A will be reflected between the reflecting member 24 and the inner wall of the dust-proof cover 6.

Figure 6:
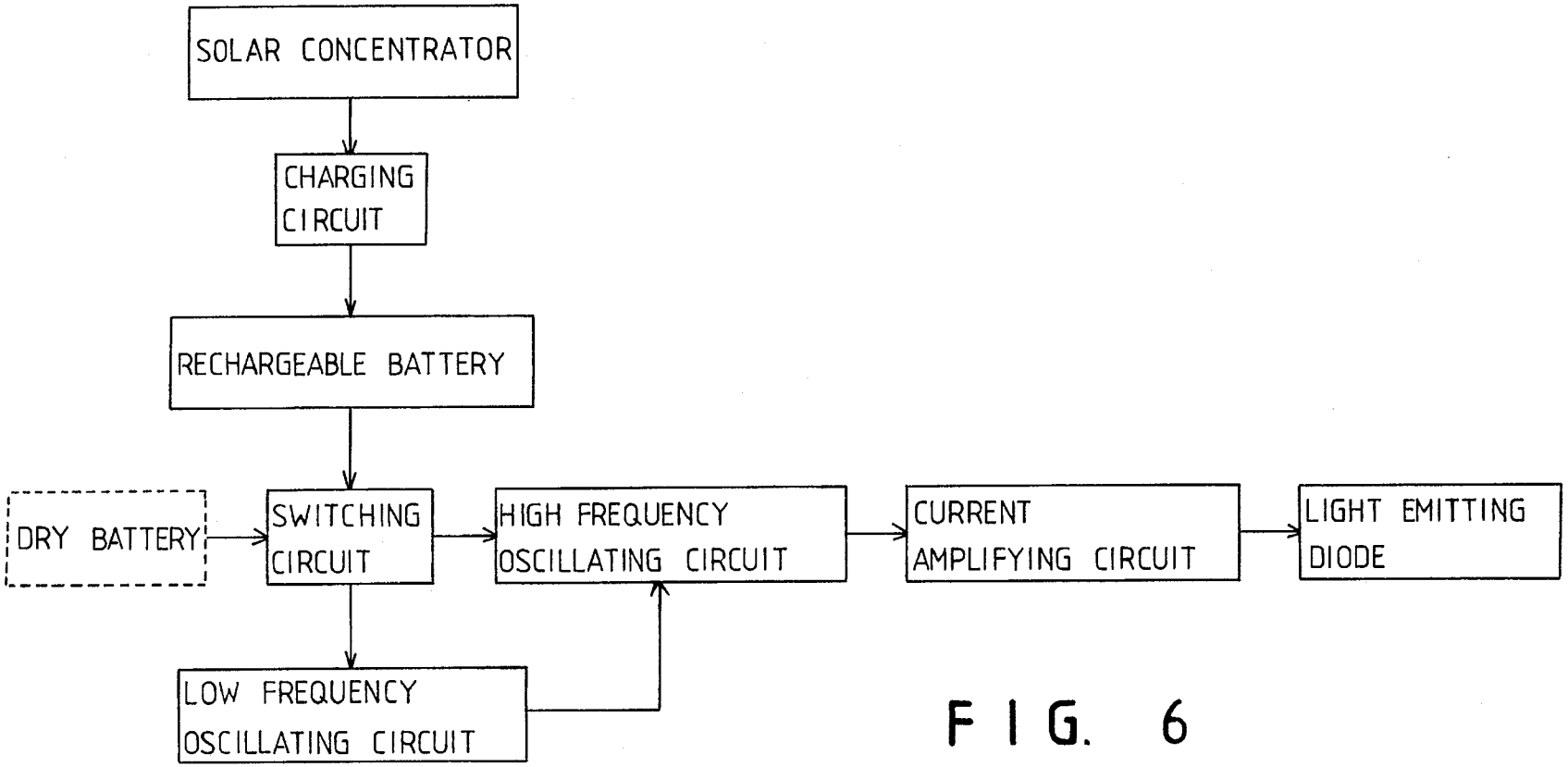
FIG. 6 is a flow chart of the present invention.

FIG. 6 is a flow chart showing the working principle of the present invention.

Figure 7:
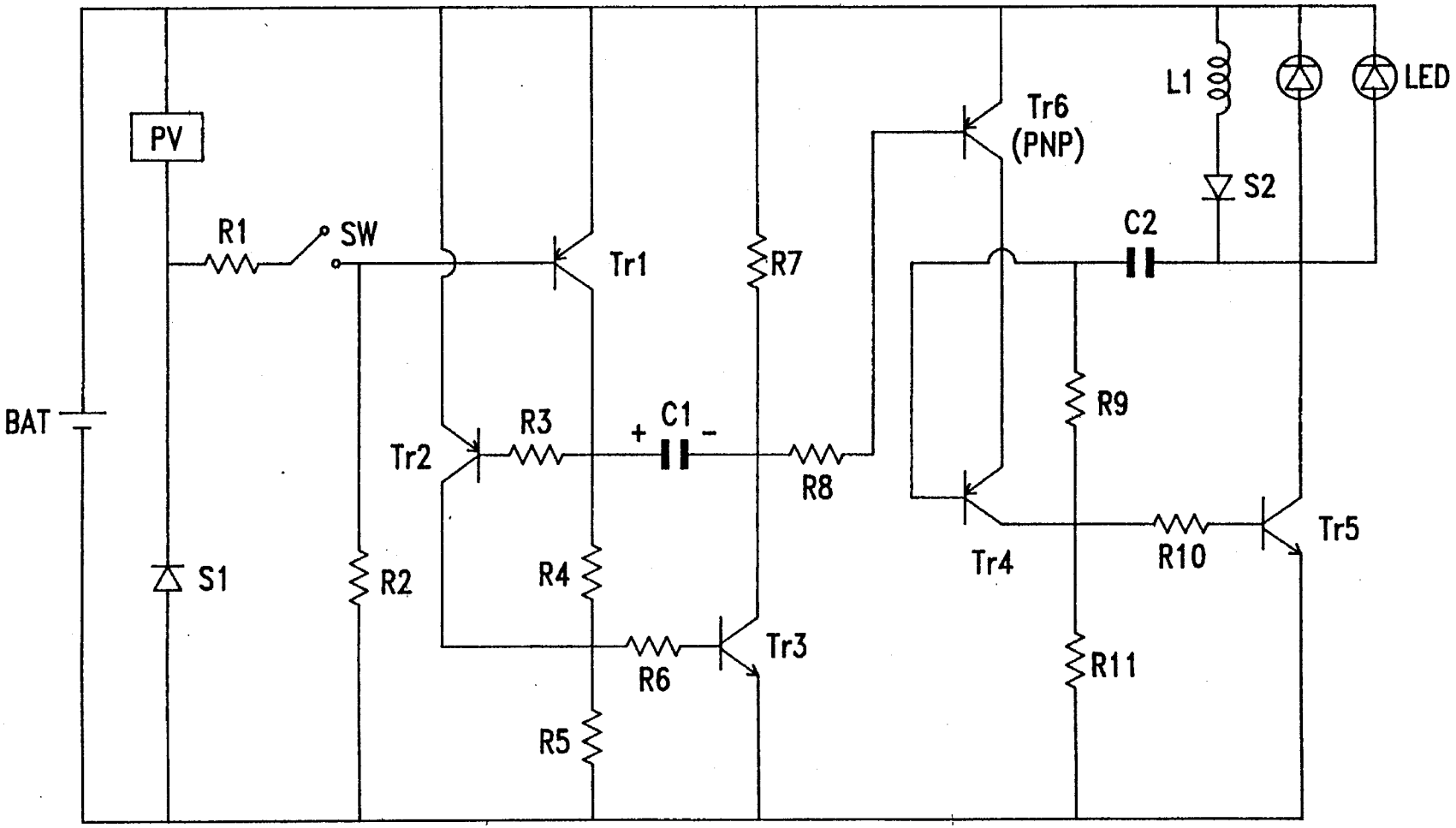
FIG. 7 shows a general electrical circuit of the present invention.

As shown in FIG. 7, the general electrical circuit of the present invention mainly comprises a charging circuit composed of a solar concentrator PV and a diode S1, a switching circuit composed of resistors R1 and R2, a transistor Tr1, the solar concentrator PV, and a switch SW, a low frequency oscillating circuit composed of transistors Tr2 and Tr3, resistors R3, R4, R5, R6 and R7, and capacitor C1, and a current amplifying circuit composed of transistors Tr4 and Tr6, a high temperature protecting circuit composed of a diode S2. Further, a battery is connected in parallel with the charging circuit. A plurality of light-emitting diodes LED are connected in parallel with the coil L1. The supplying voltage of the solar concentrator PV is set at about 2.2 VDC, because the voltage of the commonly used rechargeable nickel-cadmium cell is about 1.2 VDC. The diode S1 is used to prevent current from feeding back. In addition, the switching circuit is controlled by the solar concentrator PV. That is, when the solar concentrator PV is at a bright circumstance, the switching circuit will be turned off, and when the solar concentrator PV is at a dark circumstance, the switching circuit will be turned on. Further, the switching circuit will turn off the low frequency oscillating circuit in charging. Furthermore, the difference between the high potential and the low potential of the switching circuit can produce unequal proportion for providing a power system with predetermined percentage so as to change the frequency of on time or period. Then, the output is supplied to the high frequency oscillating circuit. As the high frequency oscillating circuit produces high voltage through the current amplifying circuit to turn on the light-emitting diodes LED, the light-emitting diodes LED will give flashing light. When the high voltage is not oscillated, the light-emitting diodes LED will give light which does not flash. The diode S2 is used to provide high temperature protection so that its resistor will become greater in normal temperature, but lesser in high temperature. Hence, the current will be increased thereby keeping the brightness of the light-emitting diodes LED.

Figure 8:
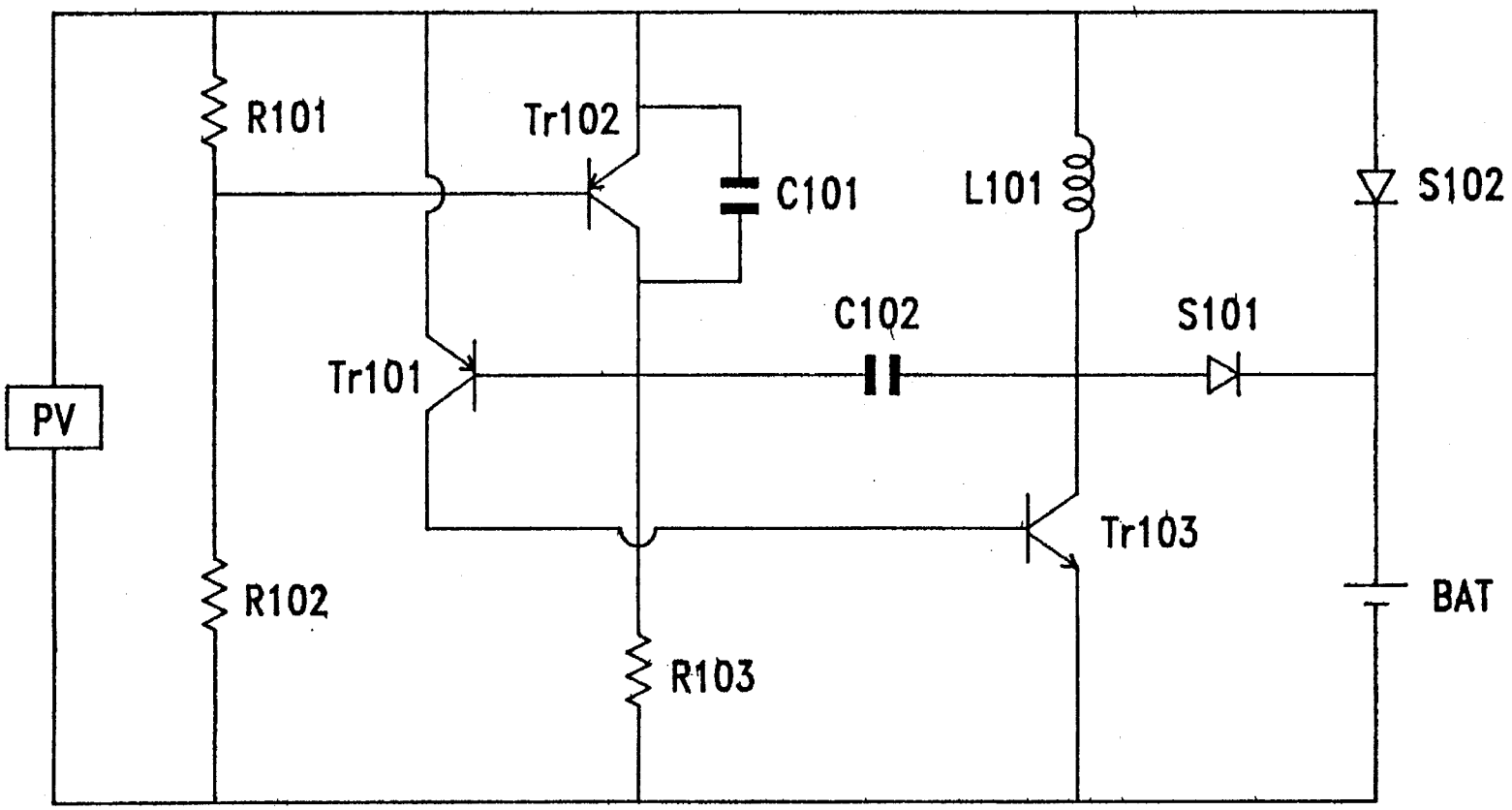
FIG. 8 shows a voltage detecting circuit of the present invention.

Further, there is a voltage detecting circuit between the battery BAT and the solar concentrator PV, which is shown in FIG. 8.

As may be seen, the voltage detecting circuit is mainly composed of resistors R101, R102, a transistor Tr102, and a capacitor C101, and designed to determine whether the voltage produced by the solar concentrator PV is sufficient to charge into the battery BAT. If the voltage is sufficient, the current will pass through a diode S102. If the voltage is insufficient, the transistors Tr102 and Tr103, the resistor R103, and the capacitor C102, the coil L101 will be oscillated to increase the voltage so that the voltage detecting circuit can make the solar concentrator PV be charged even though the solar concentrator PV is at a circumstance with insufficient light.

According to a plurality of experiments, even if the illumination intensity is at 1000 LUX, the light-emitting diodes LED will still work normally (the illumination intensity in raining daytime is about 3000–5000 LUX).

Figure 9:
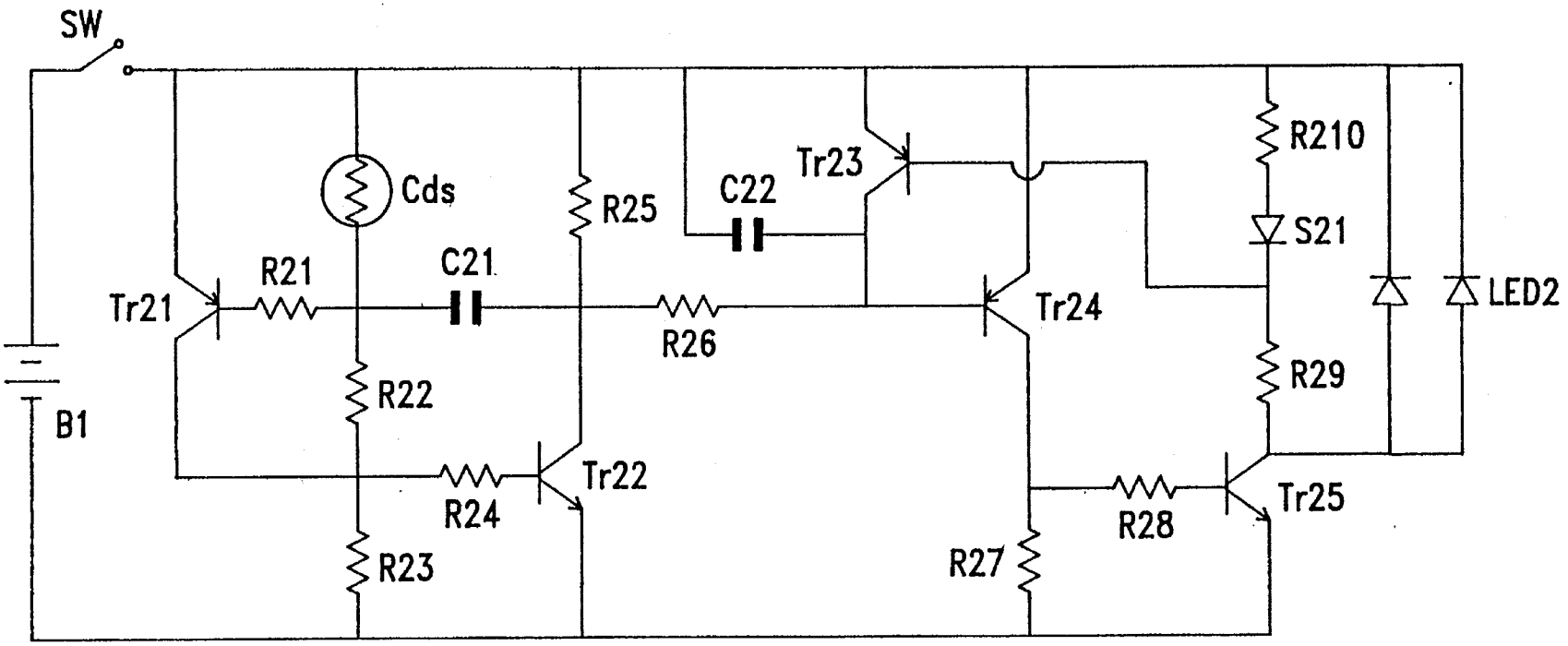
FIG. 9 shows an energy saving circuit of the present invention.

FIG. 9 shows an energy-saving circuit of the present invention. As illustrated, the energy-saving circuit mainly comprises an oscillating circuit composed of transistors Tr21 and Tr22, resistors R21, R22, R23, R24, R25 and capacitor C1, a current amplifying circuit composed of transistors Tr24 and Tr25, resistors R26, R27 and R28, and capacitor C22, and a voltage regulating circuit composed of transistor Tr23, resistors R29 and R210, and diode S21, and further comprises a power source B1, a switch SW, an illumination intensity switch Cds, and a plurality of light-emitting diodes LED2. The current amplifying circuit is used to push the light-emitting diodes LED, while the capacitor C22 is designed to prevent the transistor Tr24 from working unsteadily. As the illumination intensity of the light-emitting diode LED2 will become greatest at 1.8 volts, it is necessary to limit the voltage. The transistor Tr23 is PNP semiconductor and has a conducting voltage of 0.6 volt at 25 degrees centigrade. The resistors R29 and R210 and the diode S1 form a voltage dividing circuit. The diode S21 is a low voltage conducting diode and conducts between 0.2–0.4 volt. When the transistor Tr25 produces a voltage drop of 1.68 volts, the light-emitting diode LED2 will begin to give light. When the voltage drops to 1.8 volts, the transistor R210 and the two diodes S21 will drop the voltage to 0.6 volt thereby stopping the amplifying function of the current amplifying circuit and turning on the light-emitting diode LED2 at 1.8 volts. Since the conducting voltage of the transistor Tr23 will be decreased at the time when the temperature is increased, the voltage drop produced by the transistor R210 and the diode S21 will be decreased when the temperature is increased. Hence, the voltage regulating circuit will work at 1.8 volts. Accordingly, when the voltage drop across the LED2 is larger, the power consumption will be larger too. Thus, it will save much energy by maintaining a regular voltage.

Figure 11:
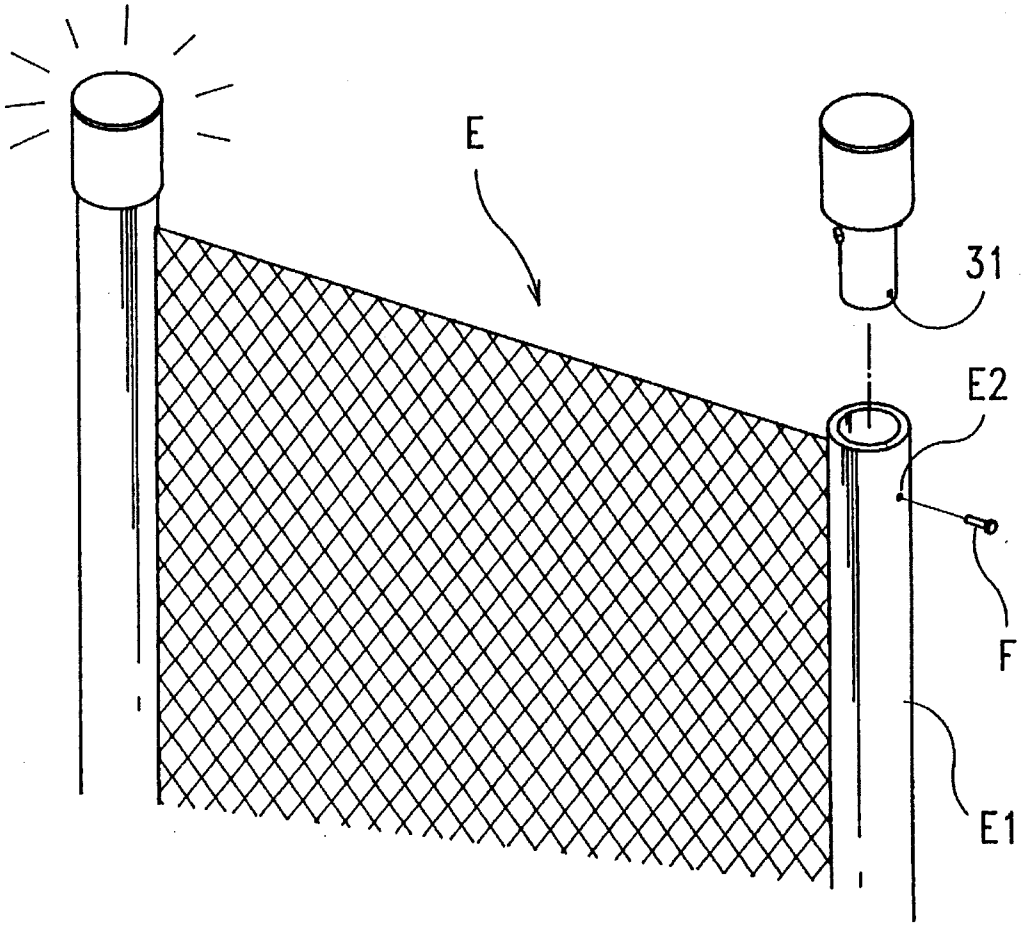
FIG. 11 shows another application of the present invention.
Figure 10:
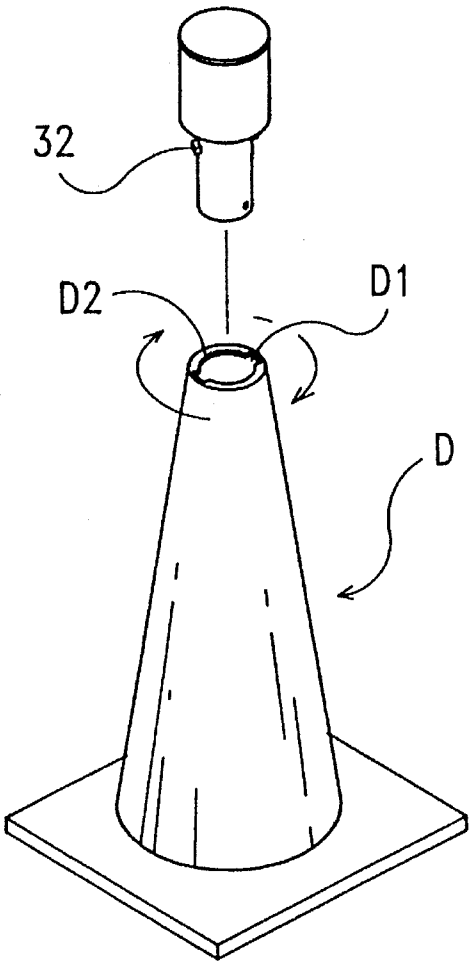
FIG. 10 shows a first application of the present invention.

FIGS. 10 and 11 show different applications of the present invention. As illustrated, the lugs 32 of the fixing device 3 may be engaged with the notches D1 of a traffic cone D so that the present invention may be conveniently mounted on the top of the traffic cone D. In addition, the present invention may be mounted on a support E1 by engaging a screw F with a threaded hole 31 through a hole E2 of the support E1.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A solar warning device comprising:

a solar chip device having a mushroom-like top with an annular flange and a rectangular recess for receiving solar cells, said rectangular recess being filled with silicon for fixing the solar cells in position, said solar chip device further having two downwardly extending legs; a reflecting device having a cylindrical casing with reflecting lines at an inner surface and a neck at a top, a light mounting disposed within said cylindrical casing and having a top plate, a base plate, a light-emitting diode fixing plate, and a pillar, said fixing plate being formed with a plurality of holes for keeping light-emitting diodes in place, a printed circuit board mounted under the base plate of said light mounting, and a conducting pin mounted on a positive pole of said printed circuit board and extending downwardly through said cylindrical casing; and a fixing device having a cylinder provided at a top with external threads adapted to engage with internal threads of the cylindrical casing of said reflecting device, ribs for keep a battery in position, and a L-shaped copper conductor having a lower end designed to be in contact with a negative pole of the battery.

2. The solar warning light as claimed in claim 1, further comprising a general circuit including:

a charging circuit composed of a solar concentrator and a diode;

a switching circuit connected to said charging circuit;

a low frequency oscillating circuit connected to said switching circuit;

a high frequency oscillating circuit having a coil and connected between said switching circuit and said low frequency oscillating circuit;

a battery connected in parallel with said charging circuit; and a plurality of light-emitting diodes connected in parallel with a coil of said high frequency oscillating circuit.

3. The solar warning light as claimed in claim 1, further comprising a charging circuit for gloomy days including:

a charging circuit composed of a solar concentrator and a diode;

a low frequency oscillating circuit connected to said charging circuit;

a high frequency oscillating circuit having a coil and connected with said low frequency oscillating circuit;

a battery connected in parallel with said charging circuit;

a voltage detecting circuit connected between said solar concentrator and said battery; and a plurality of light-emitting diodes connected in parallel with the coil of said high frequency oscillating circuit.

4. The solar warning light as claimed in claim 1, wherein said fixing device is detachably connected with said solar chip device and said reflecting device and externally connected therewith.

5. The solar warning light as claimed in claim 1, wherein said solar chip is adaptable to commonly used dry battery and can be adjusted not to carry out charging function.

6. The solar warning light as claimed in claim 1, wherein said warning light is disposed on a traffic cone.

7. The solar warning light as claimed in claim 1, wherein said light-emitting diodes is adjustable in number as.

8. The solar warning light as claimed in claim 1, wherein said charging circuit for gloomy days is adapted to a solar light.

9. The solar warning light as claimed in claim 1, wherein said light-emitting diodes are replaced with other illuminating members.

* * * * *